US008157431B2

(12) United States Patent
Musil

(10) Patent No.: US 8,157,431 B2
(45) Date of Patent: Apr. 17, 2012

(54) LOW EMISSION ENERGY EFFICIENT 100 PERCENT RAP CAPABLE ASPHALT PLANT

(75) Inventor: Joseph E. Musil, Ely, IA (US)

(73) Assignee: Terex USA, LLC, Wilmington, DE (US)

( * ) Notice: Subject to any disclaimer, the term of this patent is extended or adjusted under 35 U.S.C. 154(b) by 979 days.

(21) Appl. No.: 12/138,204

(22) Filed: Jun. 12, 2008

(65) Prior Publication Data

US 2008/0310249 A1 Dec. 18, 2008

Related U.S. Application Data

(60) Provisional application No. 60/944,174, filed on Jun. 15, 2007.

(51) Int. Cl.
*B28C 5/46* (2006.01)

(52) U.S. Cl. ..... 366/4; 366/7; 366/23

(58) Field of Classification Search ..... 366/22, 366/23, 24, 25, 4, 7
See application file for complete search history.

(56) References Cited

U.S. PATENT DOCUMENTS

| | | | | |
|---|---|---|---|---|
| 4,245,915 | A | 1/1981 | Bracegirdle | |
| 4,378,162 | A | 3/1983 | Bracegirdle | |
| RE32,206 | E | 7/1986 | Bracegirdle | |
| 4,784,216 | A | 11/1988 | Bracegirdle | |
| 4,913,552 | A | 4/1990 | Bracegirdle | |
| 4,932,785 | A | 6/1990 | Bracegirdle | |
| 5,882,592 | A | 3/1999 | Bracegirdle | |
| 5,988,864 | A | 11/1999 | Bracegirdle | |
| 6,299,380 | B1 | 10/2001 | Bracegirdle | |
| 6,855,440 | B2 | 2/2005 | Bracegirdle | |
| 6,971,784 | B1 | 12/2005 | Bracegirdle | |
| 7,758,235 | B1 * | 7/2010 | Collette | 366/7 |

* cited by examiner

*Primary Examiner* — Maria Veronica Ewald
*Assistant Examiner* — Robert J Grun
(74) *Attorney, Agent, or Firm* — Simmons Perrine Moyer Bergman PLC

(57) ABSTRACT

An HMA plant which uses combination direct exhaust heated and indirectly steam heated pre-heating drum in combination with a sealed indirect hot oil heated rotary shaft mixer, where the steam given off from the heated HMA is maintained, separated from the sulfur containing exhaust of a hot oil heater, so as to minimize the production of acid in liquid form.

18 Claims, 3 Drawing Sheets

LOW EMISSION ENERGY EFFICIENT 100 PERCENT RAP CAPABLE ASPHALT PLANT

CROSS REFERENCE TO RELATED APPLICATIONS

This application claims the benefit of the filing date of co-pending provisional patent application entitled "LOW EMISSION ENERGY EFFICIENT 100 PERCENT RAP CAPABLE ASPHALT PLANT", having Ser. No. 60/944,174, which was filed on Jun. 15, 2007, by Joseph E. Musil, which provisional patent application is incorporated herein in its entirety by this reference.

FIELD OF THE INVENTION

The present invention generally relates to hot mix asphalt (HMA) plants used in road paving and to the use of recycled asphalt pavement (RAP).

BACKGROUND OF THE INVENTION

In recent years, attempts have been made to improve the amount of hot mix asphalt products that get recycled. Conventional direct-fired prior art drum hot mix asphalt plants often utilize a mixture of virgin aggregate and RAP. Typically, a mixture of about 20% RAP and 80% virgin aggregate is considered aggressive use of RAP.

The virgin aggregate material is used to prevent the RAP from sticking to the HMA plant components and building up to cause blockages and inefficient operation. The virgin aggregate is also included to indirectly heat the RAP.

While there has been much desire to increase the amount of RAP used each year in HMA applications, and the percentage of RAP used nationally in HMA applications has been increasing since the early days of RAP, difficulties exist with increasing the percentage content of RAP in HMA. Often too much RAP in an HMA mix will result in clogging up the HMA drum or burning of the RAP or both.

Consequently, there exists a need for improved methods and systems for cost effectively increasing the RAP content of HMA in an environmentally sound manner.

SUMMARY OF THE INVENTION

It is an object of the present invention to provide a system and method for creating and preparing HMA with increased percentages of RAP in a more efficient manner.

It is a feature of the present invention to utilize a shaft HMA mixer with indirect heating of the material through a closed fluid heating system.

It is another feature of the present invention to include capturing exhaust from a fluid heating system fluid heater and using it to pre-heat RAP or RAP and virgin material.

It is yet another feature of the present invention to reduce the emission of gaseous and liquid sulfuric acids by maintaining separation between exhaust gases used to heat the HMA to a point above the boiling point of water and moisture given off by the HMA mixture when it is heated above the boiling point of water, while both are used separately to pre-heat asphalt component.

It is an advantage of the present invention to provide a relatively low emission high efficiency 100 percent RAP capable HMA plant.

The present invention is designed to satisfy the aforementioned needs, provide the previously stated objects, include the above-listed features, and achieve the already articulated advantages.

Accordingly, the present invention is a system and method including using an indirect sealed heating source to heat asphalt mixture to above the boiling point of water, capturing the exhaust from the heater used to heat the circulating heated fluid, and providing the exhaust and steam generated when the asphalt mixture exceeds the boiling point of water to separately heat a pre-heater.

BRIEF DESCRIPTION OF THE DRAWINGS

The invention may be more fully understood by reading the following description of the preferred embodiments of the invention, in conjunction with the appended drawings wherein.

DETAILED DESCRIPTION OF THE INVENTION

Figure 1:
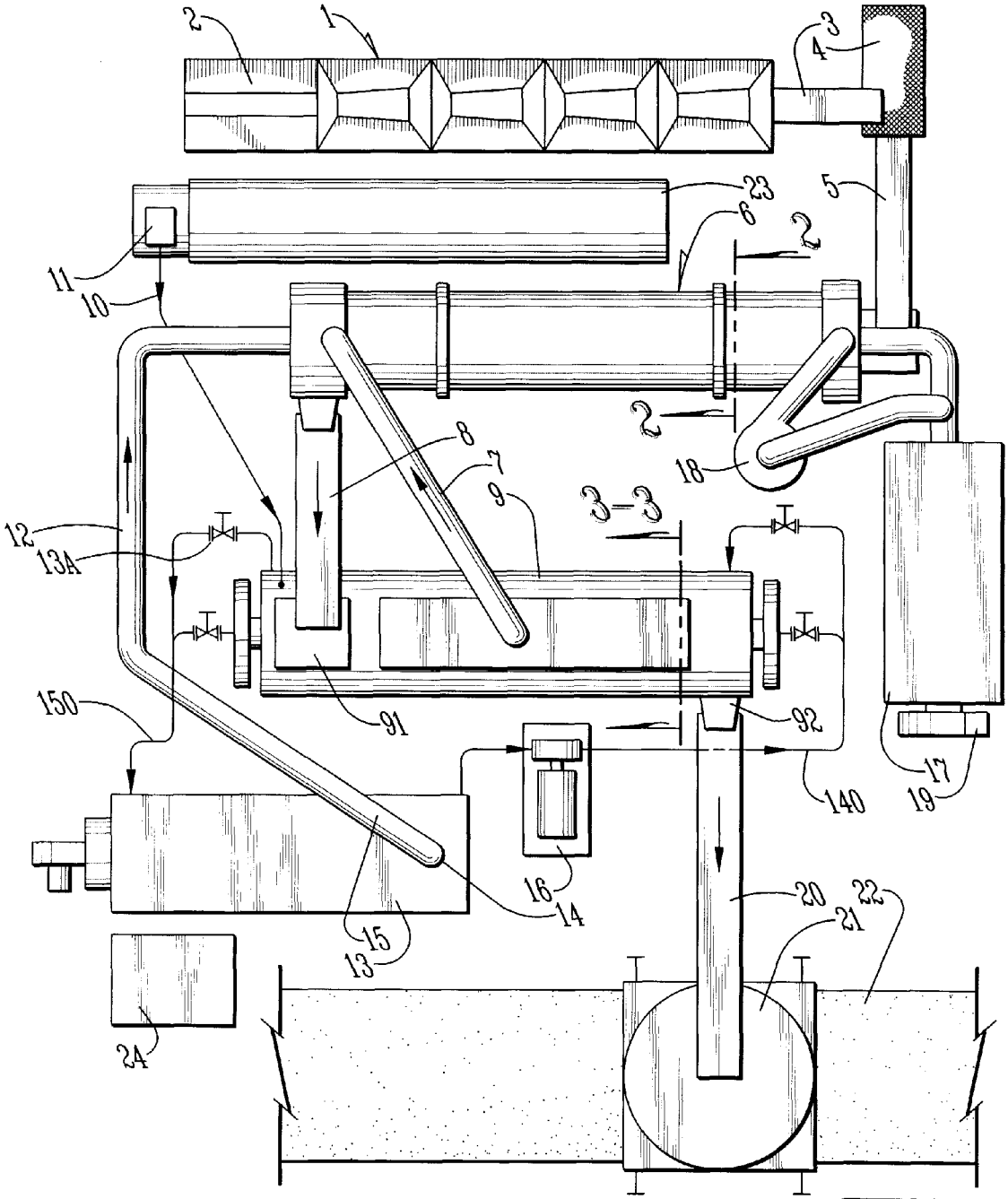
FIG. 1 is a plan view of an HMA plant of the present invention where the solid arrow represents direction of flow of various materials through the plant. The double-arrowed line 2-2 is a line along which the cross-sectional view of FIG. 2 was taken. The double-arrowed line 3-3 is a line along which the cross-sectional view of FIG. 3 was taken.

Now referring to the drawings, wherein like numerals refer to like matter throughout, and more specifically to FIG. 1, there is shown low emission energy efficient HMA high RAP capable HMA plant 100 which can be generally constructed of the same materials and in the same general manner as prior art HMA plants. Low emission energy efficient HMA high RAP capable HMA plant 100 is shown as including a multi-compartment cold feed bin 1 used to receive therein virgin aggregate material (when operating in a less than 100% RAP mode) which can be any type of bin and transport system, but a hopper and conveyor combination might be preferred. Each of the compartments of the multi-compartment cold feed bin 1 drops material down to a gathering conveyor 3 which also accepts material from the RAP feed bin 2 and takes the same to the screen 4 where undesirable matter is removed. Note other suitable matter separation devices such as grizzly bars, trommels, etc. could be used instead of and/or in addition to the screen 4. The material of the requisite size passes through screen 4 and out to weighing cold feed conveyor 5, which is a special conveyor which determines the amount of matter being provided by the weighing cold feed conveyor 5 to the rotary pre-heater 6, by measuring the weight of the matter on the conveyor, the variable conveyor speed and the duration of the various weights and integrating the same to determine mass of material provided to rotary pre-heater 6.

Rotary pre-heater 6 may be a variant of a counter-flow heated rotating drum heater where the material being heated flows in a direction opposite the direction of hot gases used to provide some of the heat to the material Shaft mixer to pre-heater steam duct 7 provides steam heat to the rotary pre-heater 6.

Figure 2:
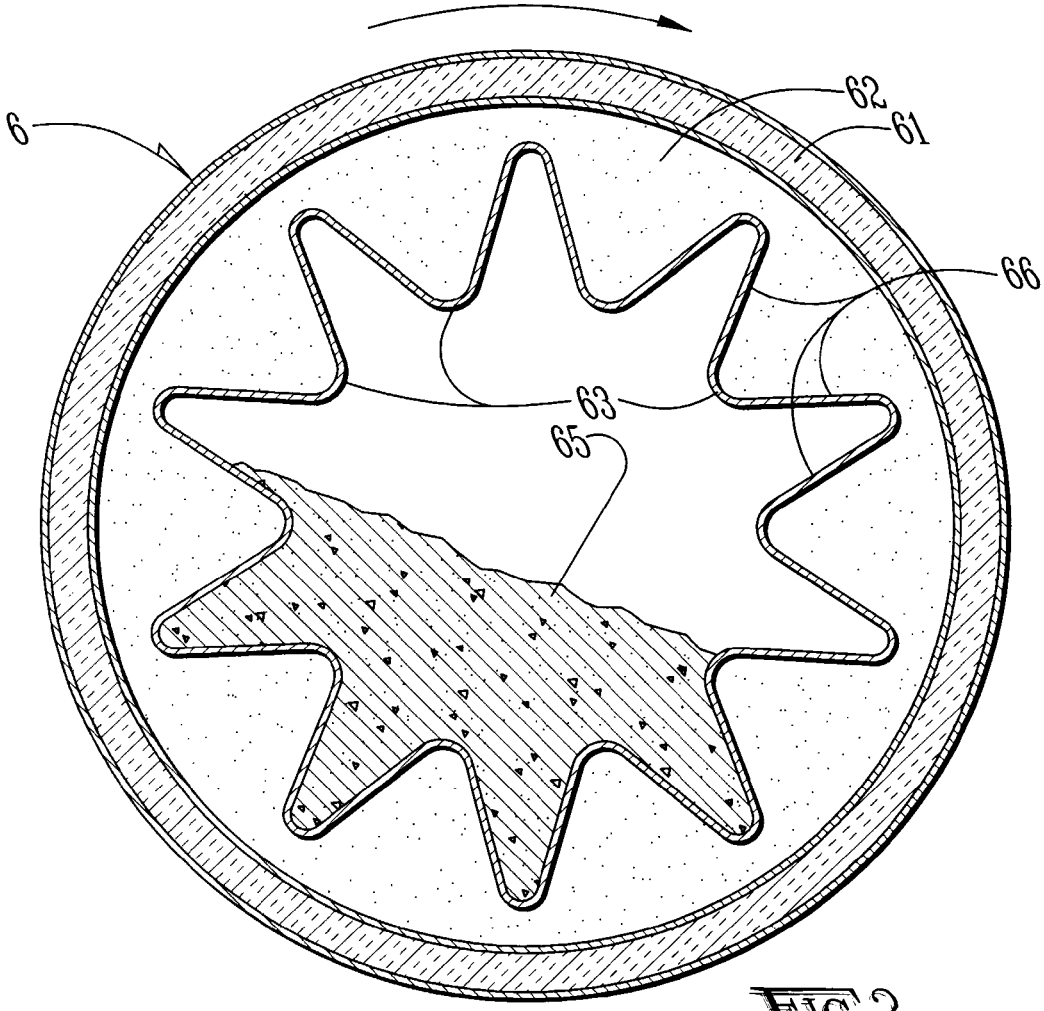
FIG. 2 is a cross-sectional view of the rotary pre-heater unit of the present invention taken on line 2-2 of FIG. 1.

Now referring to FIG. 2, there is shown a cross-sectional view of the rotary pre-heater 6 taken on line 2-2 of FIG. 1. Rotary pre-heater 6 is shown having an insulated outer wall 61, which may be a double-walled structure or other suitable structure for providing both support and insulation. Insulated outer wall 61 forms an outer barrier wall of the steam void 62 which is bounded also by internal steam barrier wall 66. Internal steam barrier wall 66 is shaped and configured to form many aggregate material-engaging flights 63 which tend to elevate a portion of the aggregate paving material surface 65. Interior to internal steam barrier wall 66 is open central counter flow heated gas passage 64 which allows direct exposure of the aggregate paving material surface 65 with hot gases moving through the rotary pre-heater 6 in an opposite direction than the aggregate paving material as it progresses through the rotary pre-heater 6. Rotary pre-heater 6 is shown as rotating in a clockwise direction; however, counter-clockwise rotation is contemplated, as well as other non-rotary and reciprocating and agitating motions.

Now referring to FIGS. 1 and 2, the rotary pre-heater 6 would preferably be inclined from left to right, so that aggregate material entering by weighing cold feed conveyor 5 tends to tumble downward with the aid of gravity to pre-heater to shaft mixer material conveyor 8. Also shown coupled to rotary pre-heater 6 is shaft mixer to pre-heater steam duct 7, which provides the steam to heat the steam void 62. Also shown is the hot oil heater to pre-heater exhaust gas duct 12 which provides heated exhaust gases to the open central counter-flow heated gas passage 64. The connections of shaft mixer to pre-heater steam duct 7 and hot oil heater to pre-heater exhaust gas duct 12 to rotary pre-heater 6 can be done using well-known techniques which might include rotary air lock or other seal means.

The heated exhaust gases entering the rotary pre-heater 6 via hot oil heater to pre-heater exhaust gas duct 12 exit the rotary pre-heater 6 and go into the fabric filter house 17, where they are filtered. Fabric filter house 17 filters either or both of: 1) the air remaining in the steam void 62 as the steam cools the water, precipitates out and 2) the gases from open central counter-flow heated gas passage 64 originally from hot oil heater to pre-heater exhaust gas duct 12.

Cyclone separator 18 is located between the exit of the rotary pre-heater 6 and the entrance of fabric filter house 17. Cyclone separator 18 or other separator may use negative pressure provided by a centrifugal fan, etc. to constantly remove dust and water vapor existing in the effluent of the drying/preheating process. Fabric filter house 17 exhausts to exhaust fan 19 and some type of exhaust stack or vent.

Figure 3:
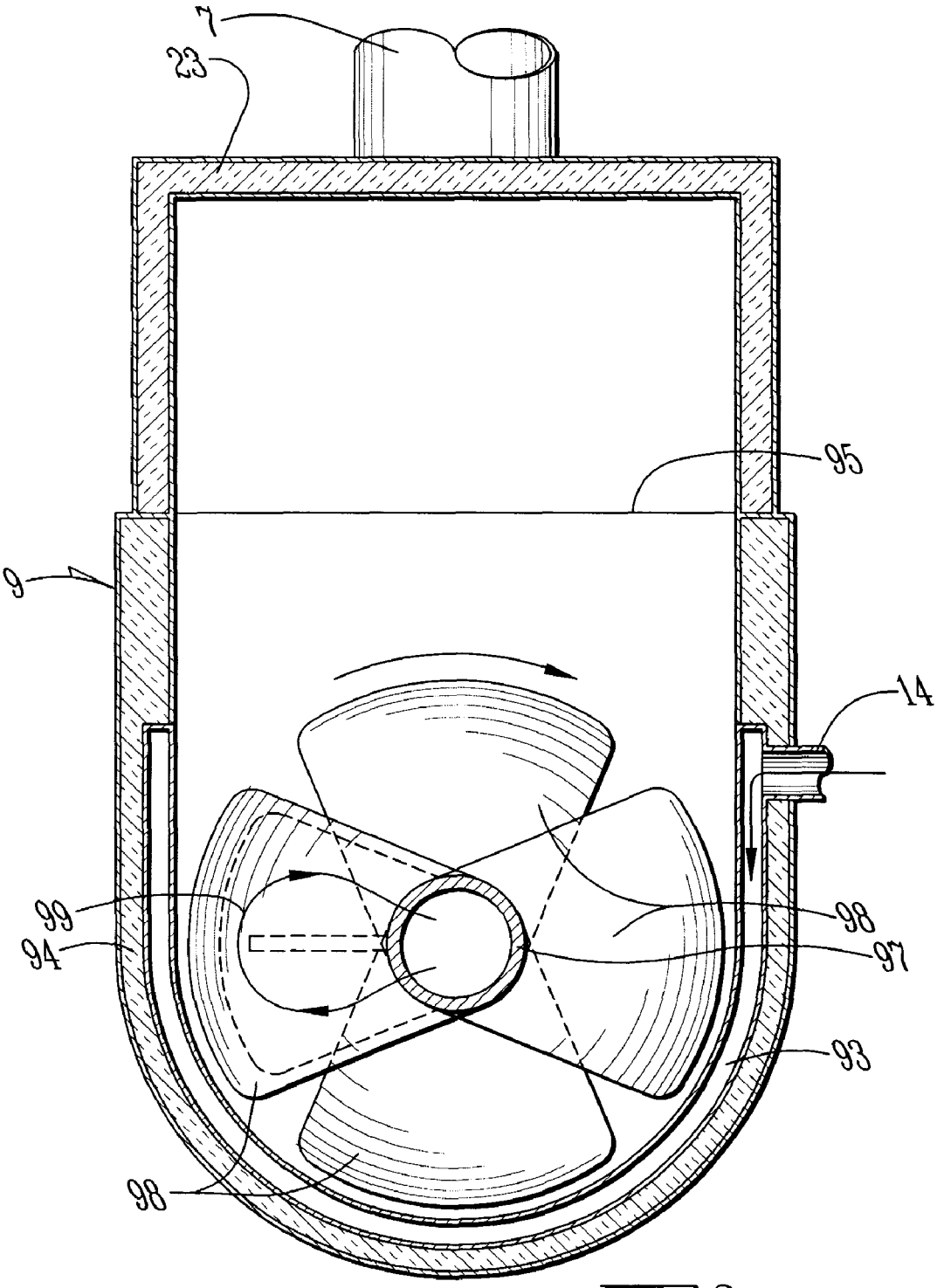
FIG. 3 is a cross-sectional view of the rotary shaft mixer unit of the present invention taken on line 3-3 of FIG. 1.

Now referring to FIGS. 1 and 3, depending upon the heat of the hot oil, the temperature of the pre-heated materials and the speed of material, the rotary shaft mixer 9 heats the HMA to a final level (approximately 600 degrees F.) and mixes the RAP, any virgin aggregate, liquid asphalt (from heated liquid asphalt storage tank 23 via liquid asphalt metering apparatus 11 and liquid asphalt delivery pipe 10) or other materials. Rotary shaft mixer 9 operates in a counter-flow heating manner in the sense that the flow of hot oil through the rotary shaft mixer 9 moves from right to left; i.e., opposite the direction of flow of the HMA through the rotary shaft mixer 9.

Hot oil enters the rotary shaft mixer 9 from combustion-fired hot oil heater 13 via oil pump 16 and hot oil supply line 140, which then returns from the rotary shaft mixer 9 to the combustion-fired hot oil heater 13 via hot oil return line 150. The HMA in rotary shaft mixer 9 is heated indirectly by heated oil passing through hollow central shaft/oil pipe 97 which conveys the heated oil from end to end of the rotary shaft mixer 9. As the hollow central shaft/oil pipe 97 spins, the numerous large-angled heated paddles 98 coupled thereto also move, thereby mixing and pushing the HMA in one direction. Large-angled heated paddles 98 are heated by allowing hot oil to flow from the hollow central shaft/oil pipe 97 into interior paddle hot oil flow passages 99. The oil flow through the hollow central shaft/oil pipe 97 can be balanced with the oil flow through the insulated exterior oil jacket 93 about the insulated exterior wall 94. Top side 95 of rotary shaft mixer 9 may be beneath a bottom side of heated liquid asphalt storage tank 23. This would allow some of the heat of the rotary shaft mixer 9 to be used to heat the heated liquid asphalt storage tank 23.

The source of the hot oil is combustion-fired hot oil heater 13, which heats the oil to approximately 750 degree F. Combustion-fired hot oil heater 13 may include elements such as a thermal expansion tank and controls.

The exhaust of combustion-fired hot oil heater 13, via hot oil heater exhaust exit discharge point 14, provides heated gases via hot oil heater to pre-heater exhaust gas duct 12 to rotary pre-heater 6 if the hot oil heater exhaust valve 15 is in an open configuration. Hot oil heater exhaust valve 15 could be a valve that selectively directs the exhaust of the combustion-fired hot oil heater 13 to either the rotary pre-heater 6 or to the atmosphere (through a port not shown) or a combination or mixture of the two, depending upon the needs of the rotary pre-heater 6.

Input and exit of material from rotary shaft mixer 9 could be through various conveyors and connections. In one configuration, the shaft mixer input connection 91 could be a rotary air lock; also the exit connection 92 could be a rotary air lock.

Storage conveyor 20 may be a drag slat or other conveyor or material-moving apparatus which is suitable to move the material from the rotary shaft mixer 9 to the storage silo 21 or other suitable storage. Driveway scale 22 is a scale for measuring the weight of the material hauled away in trucks.

Heated liquid asphalt storage tank 23 is a tank for storing and heating liquid asphalt.

Lastly, control house 24 is shown without any wires connecting it to the various elements and valves through the low emission energy efficient HMA high RAP capable HMA plant 100, but it should be understood that any means for communicating information could be used, including wired and wireless connects.

In operation, the low emission energy efficient HMA high RAP capable HMA plant 100 operates generally as follows:

RAP is added to RAP feed bin 2, virgin aggregate is added to multi-compartment cold feed bin 1, the material is weighed and input into rotary pre-heater 6. Rotary pre-heater 6 is separately heated by exhaust of combustion-fired hot oil heater 13 and by steam generated when rotary shaft mixer 9 raises the HMA above the boiling point of water. Rotary pre-heater 6 pre-heats the RAP and virgin material to a temperature approaching the boiling point of water inside the rotary pre-heater 6. The fact that the steam is kept separate from the exhaust of the combustion-fired hot oil heater 13, and the RAP and virgin material is not heated so high as to create steam, the amount of sulfuric acid produced by the low emission energy efficient HMA high RAP capable HMA plant 100 is much reduced. (Note: many prior art HMA plants produce sulfuric acid, but they do so in a gaseous state which is released to the atmosphere. The rotary pre-heater 6 provides the pre-heated material to the rotary shaft mixer 9, where the final heating and mixing of the HMA occurs. As the HMA is heated above the boiling point of water in the rotary shaft mixer 9, steam is generated and selectively allowed to flow to the steam void 62 in rotary pre-heater 6, where it heats internal steam barrier wall 66 and indirectly heats the material in open central counter-flow heated gas passage 64.

The heat applied via hot oil heater to pre-heater exhaust gas duct 12 and shaft mixer to pre-heater steam duct 7 is carefully regulated, and the temperature inside of rotary pre-heater 6 is monitored, so as to approach, but not exceed, the boiling point of water.

The HMA in rotary shaft mixer 9 is indirectly heated by circulating the hot oil through the various closed areas adjacent to the HMA; e.g., the interior paddle hot oil flow passages 99 in large-angled heated paddles 98, the jacket 93 in insulated exterior wall 94, and the hollow central shaft/oil pipe 97.

Manipulation of the various valves in the low emission energy efficient HMA high RAP capable HMA plant 100 can provide for optimal operation. For example, the hot oil supply line 14 has a remotely controllable (wired or wireless) valve controller at the inlet to the hollow central shaft/oil pipe 97 and the jacket 93. Similarly the corresponding outlets from the opposing end of the rotary shaft mixer 9 have such valve controllers. These valve controllers can be manipulated to regulate the flow rates and therefore temperature of the HMA in the rotary shaft mixer 9.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A method of mixing HMA comprising the steps of:

providing a rotary drum pre-heater configured to move RAP in a first direction and to preheat said RAP to a temperature approaching, but not more than the boiling point of water inside of said rotary pre-heater;

directing such pre-heated RAP to a rotary shaft mixer;

using said rotary shaft mixer for providing direct heating of said pre-heated RAP to a temperature of approximately 600 degrees F.;

providing an oil heater to heat oil and to provide the heated oil to movable portions of said rotary shaft mixer, so as to heat such movable portions and thereby indirectly heat HMA disposed within rotary shaft mixer;

providing exhaust from an oil heater to an open central counter-flow heated gas passage within the rotary pre-heater;

providing steam from the rotary shaft mixer to a steam void in the rotary pre-heater;

maintaining separation of the steam and the exhaust of the oil heater until such time as the water vapor has condensed from the steam to a liquid state; and regulating the temperature and the amount of exhaust and steam provided to the rotary drum pre-heater, so that the steam in the steam void does cool sufficiently to condense to a liquid before being exhausted separate from the air exiting the rotary pre-heater.

2. The method of claim 1 wherein said rotary drum pre-heater is a counter flow rotary drum where hot gases flow in a second direction over said RAP as it moves through said rotary drum pre-heater in said first direction; and wherein said first direction is substantially opposite said second direction.

3. The method of claim 2 wherein said rotary drum pre-heater has a material input end and a material output end; and receives said steam from said rotary shaft mixer and said exhaust from oil heater both at said material output end.

4. The method of claim 3 wherein said rotary drum pre-heater is inclined upward from said material output end to said material input end.

5. The method of claim 1 further comprising a weighing cold feed conveyor and wherein said oil heater heats said oil to approximately 750 degrees F.

6. The method of claim 1 wherein said rotary drum pre-heater is constructed with a material and exhaust gas zone through which said RAP and said exhaust move in substantially opposite directions and a separate steam zone which receives said steam and allows said steam to indirectly pre-heat said RAP flowing from said material input end to said material output end and thereby allow for pre-heating of said RAP without introducing moisture therein from said steam.

7. The method of claim 6 wherein said rotary drum pre-heater is regulated with a weighing cold feed conveyor providing information for regulation which relates to the weight of the RAP and the rate of RAP entering said rotary drum pre-heater.

8. The method of claim 7 wherein said rotary drum pre-heater is coupled to a cyclone separator.

9. The method of claim 8 wherein said rotary drum pre-heater is coupled to a filter house.

10. The method of claim 9 wherein said rotary drum pre-heater is insulated exterior of an outside wall of said steam zone.

11. A system for mixing HMA comprising:

a rotary drum pre-heater configured to move RAP in a first direction and to preheat said RAP to a temperature approaching, but not more than the boiling point of water inside of said rotary pre-heater;

said rotary drum pre-heater configured for directing such pre-heated RAP to a rotary shaft mixer;

rotary shaft mixer configured for providing direct heating of said pre-heated RAP to a temperature of approximately 600 degrees F.;

an oil heater configured to heat oil to approximately 750 degrees F. and to provide the heated oil to movable portions of said rotary shaft mixer, so as to heat such movable portions and thereby indirectly heat HMA disposed within rotary shaft mixer;

an exhaust pipe configured for providing exhaust from an oil heater to an open central counter-flow heated gas passage within the rotary pre-heater;

a steam pipe configured for carrying steam from the rotary shaft mixer to a steam void in the rotary pre-heater;

said rotary drum pre-heater configured for maintaining separation of the steam and the exhaust of the oil heater until such time as the water vapor has condensed from the steam to a liquid state; and a regulator for regulating the temperature and the amount of exhaust and steam provided to the rotary drum pre-heater, so that the steam in the steam void does cool sufficiently to condense to a liquid before being exhausted separate from the air exiting the rotary pre-heater.

12. The system of claim 11 wherein said rotary drum pre-heater is a counter flow rotary drum where hot gases flow in a second direction over said RAP as it moves through said rotary drum pre-heater in said first direction; and wherein said first direction is substantially opposite said second direction.

13. The system of claim 12 wherein said rotary drum pre-heater has a material input end and a material output end; and receives said steam from said rotary shaft mixer and said exhaust from oil heater both at said material output end.

14. The system of claim 13 wherein said rotary drum pre-heater is inclined upward from said material output end to said material input end.

15. The system of claim 11 further comprising a weighing cold feed conveyor.

16. The system of claim 11 wherein said rotary drum pre-heater is constructed with a material and exhaust gas zone through which said RAP and said exhaust move in substantially opposite directions and a separate steam zone which receives said steam and allows said steam to indirectly pre-heat said RAP flowing from said material input end to said material output end and thereby allow for pre-heating of said RAP without introducing moisture therein from said steam.

17. A system comprising;

means for providing a rotary drum pre-heater configured to move RAP in a first direction and to preheat said RAP to a temperature approaching, but not more than the boiling point of water inside of said rotary pre-heater;

directing such pre-heated RAP to a rotary shaft mixer;

means for providing direct heating of said pre-heated RAP to a temperature of approximately 600 degrees F.;

means for heating oil to approximately 750 degrees F. and to provide the heated oil to movable portions of said rotary shaft mixer, so as to heat such movable portions and thereby indirectly heat HMA disposed within rotary shaft mixer;

means for providing exhaust from an oil heater to an open central counter-flow heated gas passage within the rotary pre-heater;

means for providing steam from the rotary shaft mixer to a steam void in the rotary pre-heater;

means for maintaining separation of the steam and the exhaust of the oil heater until such time as the water vapor has condensed from the steam to a liquid state; and means for regulating the temperature and the amount of exhaust and steam provided to the rotary drum pre-heater, so that the steam in the steam void does cool sufficiently to condense to a liquid before being exhausted separate from the air exiting the rotary pre-heater.

18. The system of claim 17 wherein said means for regulating the temperature and the amount of exhaust and steam comprises a weighing cold conveyor.

* * * * *